US005257425A

United States Patent [19]

Shinabarger

[11] Patent Number: 5,257,425

[45] Date of Patent: Nov. 2, 1993

[54] DEPENDENT PATIENT TRANSFER DEVICE

[76] Inventor: Bob D. Shinabarger, 5602 Sunset Dr., Cheyenne, Wyo. 82009

[21] Appl. No.: 998,408

[22] Filed: Dec. 29, 1992

[51] Int. Cl.[5] ..... A61G 7/10

[52] U.S. Cl. ..... 5/81.1; 5/86.1; 5/507.1

[58] Field of Search ..... 5/81.1, 83.1, 86.1, 5/507.1, 658, 662; 297/DIG. 10

[56] References Cited

U.S. PATENT DOCUMENTS

| | | | |
|---|---|---|---|
| 1,349,674 | 8/1920 | Jenkins | 5/86.1 |
| 2,445,619 | 7/1948 | Josephs | 5/507.1 X |
| 3,041,636 | 7/1962 | Twedt | 5/81.1 |
| 3,668,723 | 6/1972 | Bratton | 5/662 X |
| 4,435,863 | 3/1984 | Lerich . | |
| 4,694,182 | 10/1990 | Schmerler | 5/81.1 |
| 5,148,559 | 9/1992 | Morris | 5/81.1 X |

FOREIGN PATENT DOCUMENTS

| | | | |
|---|---|---|---|
| 995235 | 6/1965 | United Kingdom | 5/81.1 |

OTHER PUBLICATIONS

Flaghouse REHAB Catalog 1992.
Preston Catalog 1991.

*Primary Examiner*—Michael F. Trettel
*Attorney, Agent, or Firm*—Dean P. Edmundson

[57] ABSTRACT

A dependent patient transfer device is described for transporting a patient from one support (e.g., a bed) to another support (e.g., a commode). The device includes a wheeled frame and a seating portion. The seat is movable between a first position for supporting the patient in a seated position and a second position where the seat is out of the pathway of the patient during loading or unloading. The transfer device is sturdy, efficient, and easy to use. It enables heavy care dependent patients to be readily transported.

12 Claims, 3 Drawing Sheets

DEPENDENT PATIENT TRANSFER DEVICE

FIELD OF THE INVENTION

This invention relates to devices and apparatus for transporting a dependent heavy care patient or individual from a bed to a chair or commode and vice versa. More particularly, the present invention relates to devices and apparatus for use in facilitating transport of a patient who requires some, but not total, assistance for movement.

BACKGROUND OF THE INVENTION

Care providers (e.g., nurses, nurses aides, and family members) in private homes, hospitals, and extended care facilities are faced with the task of repeatedly moving heavy, debilitated patients from their beds to their wheelchairs or to a bathroom commode and back again. If there are enough aides available, it is possible to lift the patient manually and move the patient from one location to another. However, when there is an insufficient number of persons available to assist, it is possible that someone could become injured while attempting to move the patient.

Patients, especially debilitated elderly patients, must be moved frequently during the day to meet their basic needs. This can amount to 6 to 12 or more times per day. Debilitated patients cannot be left in bed for long periods of time without suffering the adverse effects of bed rest (i.e., bed sores, contractures, congestive heart failure, orthostatic hypotension, etc.).

The average hospital bed is 26½ inches high, the average chair or wheelchair is 18 inches high. For a 110 pound assistant to move a 180 pound dependent person from a wheelchair to bed is a formidable task often leading to strain or injury for both patient and helper as well as increased medical costs.

A further problem is that with respect to hospitals and nursing homes the workers are rushed because the facilities are often under-staffed, and the workers may have received only minimal training and are afraid to use, or are unwilling to use, complicated or cumber some transfer devices. Thus, the potential exists for the worker or patient, or both, to become injured during transfer of the patient.

Although there are complicated and expensive systems available for moving severely paralyzed patients (e.g., paraplegic, quadriplegic, etc.), such systems may not be practical or efficient for use in transporting less disable patients. For example, in U.S. Pat. No. 4,435,863 there is described apparatus for moving patients who are totally disabled. Other systems involving sling arrangements have also been used. The patient must be first placed in the sling and then the sling is moved by means of overhead apparatus in order to transfer the patient. Slings are cumbersome and are not easy to use. Also, slings can cause abrasions.

Some prior devices are quite expensive, complicated to use, and potentially frightening to geriatric patients. For example, a prior device known as the "Ambulator" involves a complex system of hand grips, shoulder supports, electrically operated hydraulics and attachments that must be added to allow bed and commode transfers. Trying to fit confused geriatric patients into the frame would be very challenging and very frightening to the patient. The operator has to stand behind the patient and operate electric switches to control and operate the device. Someone who has never operated the device would be intimidated by it. They would require considerable instruction and practice to operate it safely.

The Hydraulic Patient Lifter (Preston/Bissell) is essentially a metal boom on wheels. A spreader bar and chains hang from the top of the boom and attach to a canvas sling. The sling must be placed under the patient and then the chains are attached. If the chains are not attached properly in terms of length and sequence, the patient can be pitched from the sling. Geriatric patients who find themselves swinging and suspended from the end of the metal boom are easily frightened. Each patient must have their own sling. If the patient is placed on a commode the sling must remain under the patient and is easily soiled. The operator must be very skilled in using the lift or the patient can be pinched by the chains, pitched out of the sling, or struck in the head or face by the metal spreader bar. In addition, if the operator is unfamiliar with the hydraulics, the patient can be suddenly "dropped". Many care givers avoid using the device because of its time consuming complexity.

There has not heretofore been provided a patient transfer device for easily and efficiently transferring a dependent patient from one support to another support.

SUMMARY OF THE PRESENT INVENTION

In accordance with the present invention there is provided a dependent patient transfer device which is very useful and easy to operate for moving a patient from one support (e.g., a bed) to another support (e.g., a bathroom commode). The patient transfer device is useful for moving a person who is between 100 and 300 pounds, can follow one step commands, has the functional use of at least one arm and one leg, and who can at best manage three to five steps or at least can with assistance stand briefly on his or her leg(s) for up to five seconds. This type of person is so debilitated as to require maximum assistance of one or more persons for any and all transfers.

The patient transfer device of the invention in one embodiment comprises:

(a) frame means having a wheeled base member and at least one upright member supported by the base member; the base member including a step portion for supporting the patient in a standing position;

(b) seat means carried by the frame means and being movable between (1) a first position for supporting the patient in a seated position, and (2) a second position which is out of the pathway of the patient during loading and unloading of the patient.

The patient transfer device is safe, sturdy, low in cost, efficient, and easy to use for moving heavy care dependent people from bed to chair or bathroom, and vice versa, without excessive effort or strain for either the patient or the care provider.

The device requires minimal input by the patient and operates without complicated and dangerous booms, chains, slings, hydraulic systems, or electric motors. The device can be readily operated by even inexperienced persons, and it is easily maneuvered. The device enables a person to be transported from bed to bathroom in one operation.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
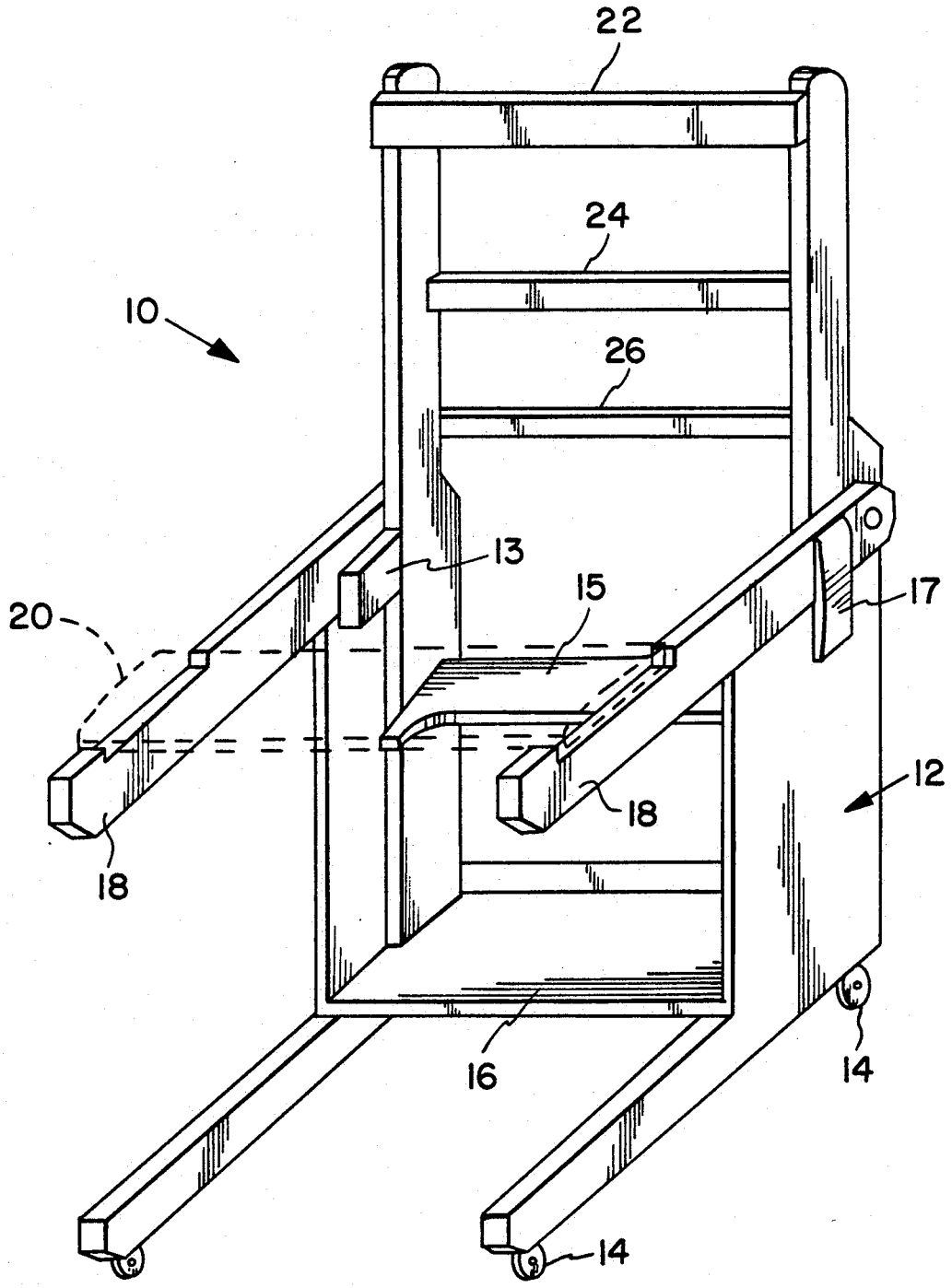
FIG. 1 is a perspective view of one embodiment of dependent transfer device of this invention.

In the drawings there is shown a dependent patient transfer device 10 for transferring a patient from one location to another. The device comprises a frame having a wheeled base member 12 supported on wheels 14. One or more of the wheels may include a foot brake. The base member includes a step portion 16 for a patient to stand on during the transfer process, as described in detail hereafter. An upper step 15 is included for the patient to rest his or her feet during transfer.

Arms 18 are pivotably mounted at one of their ends to the upright portion of the frame. The arms each include a recessed area for receiving a seat member 20 for the patient to sit on while being transferred. The seat can be removed when loading or unloading. The arms 18 can be pivotably moved between vertical and horizontal positions. The arms are prevented from moving laterally by restraints 13 and 17.

The frame also includes upper grab bar 22 and lower grab bar 24 for the patient to grip during loading and unloading. Bar 26 serves as a handle or push bar for the operator to use when moving the device.

The transfer device can be used with or without the seat 20. If it is used without the seat, the patient simply stands on the lower step 16 and holds on to the upper grab bar 22 or lower grab bar 24 and is transported from one support (e.g., a bed) to another support (e.g., a commode).

Figure 3:
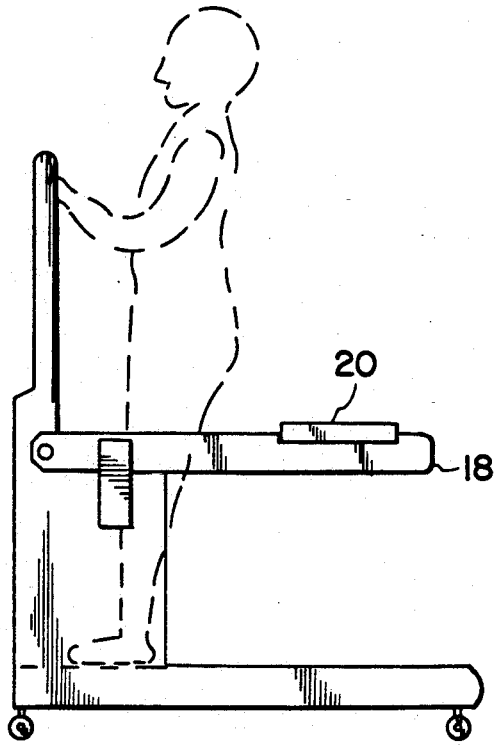
FIG. 3 is a side elevational view illustrating a patient a standing position on the device.

If the transfer device is used with the seat, the arm supports 18 are placed on either side of the patient, and the patient need only partially stand to a height that will allow the seat 20 to be placed under him or her. This is illustrated in FIG. 3. Once the patient is seated on the seat 20, the patient can place his or her feet on the upper foot rest support 15 or the lower step portion 16, whichever is more comfortable.

Figure 2:
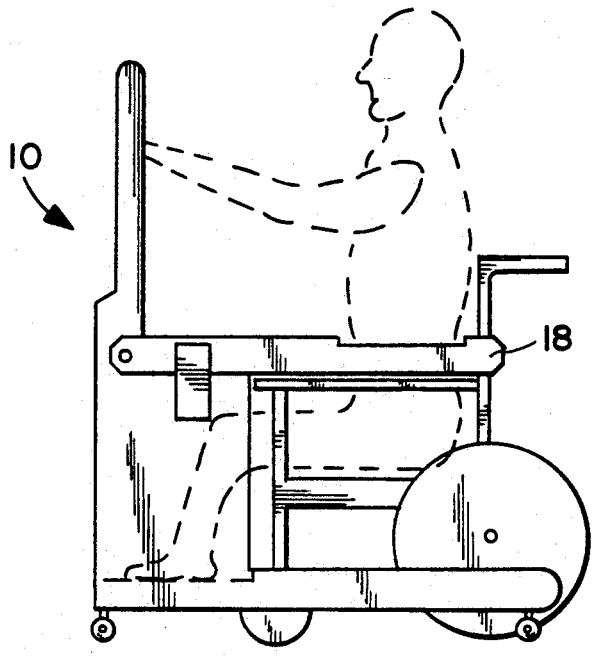
FIG. 2 is a side elevational view illustrating positioning of the transfer device adjacent a patient in a wheelchair.

FIG. 2 illustrates how a patient in a wheel chair may be wheeled between the legs and arms of the transfer device. Then the patient may place his or her feet on the lower step portion 16 of the base of the device and then can take hold of the upper or lower grab bars. The patient can pull himself or herself to a standing position (with assistance as needed) so as to allow the seat 20 to be placed in the recessed area in the arms 18. Then the patient can sit on the seat. The patient's feet may be positioned on the upper step 15, if desired.

The patient is then transferred to the next location by the attendant or operator of the transfer device. The patient holds onto one of the grab bars during the transfer.

Figure 4:
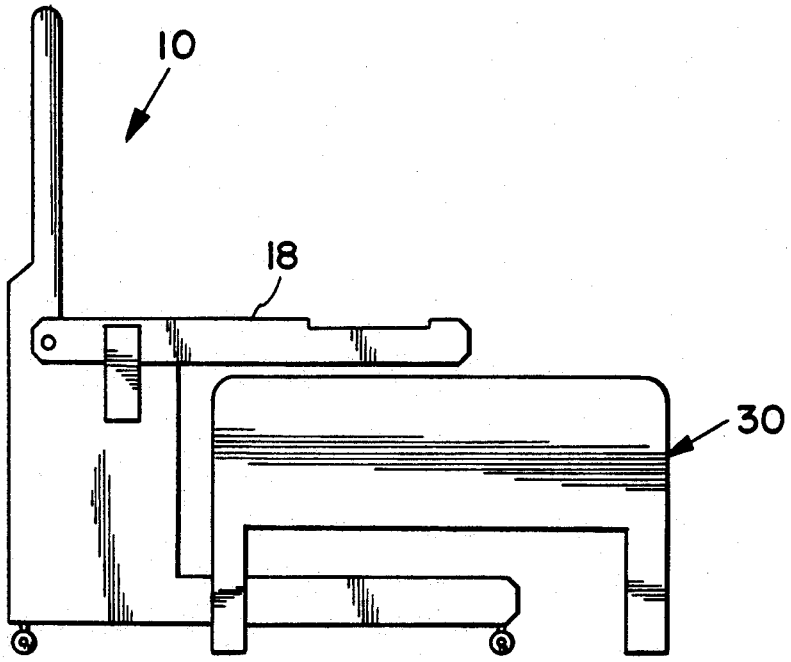
FIG. 4 is a side elevational view illustrating positioning of the transfer device adjacent a bed.

The transfer device is sufficiently wide to permit a wheelchair to be received between the legs and arms of the device. Also, the arms 18 are sufficiently high to enable the device to be wheeled next to a bed 30, as illustrated in FIG. 4 so that a patient sitting on the bed can be transferred to the device (or vice versa).

Should the patient's status be complicated by a braced, splinted, casted or stiff immovable leg, the limb can simply be placed through the vertical supports and comfortably rested on the upper step. The upper step provides a convenient platform for this purpose. Other than wheel chairs with elevating foot rests and rolling stretchers, no other patient transfer device offers this feature. In addition the upper step functions as a "booster" step for assisting the patient to seat themselves on high beds.

If the patient is transported to a commode, the seat is simply removed and the patient is lowered onto the commode. There are no slings or other devices in the way that will have to be cleaned if soiled in the process. If the patient is wearing clothes or a diaper, the patient can stand, hold onto the upper grab bar which, together with the frame, offers a solid comfortable support. The care giver can then easily and conveniently lower or remove the diaper or clothing.

The transfer device of the invention is economical, simple and easy to use, and allows the care giver to move a heavy patient from one point to another (e.g., from a bed to a commode and back again without significant strain to either care giver or patient. Also, the device can be easily pivoted and moved in any direction and is easily maneuvered.

The transfer device can be made in any size so that it can be used for children or for very large persons. Also, the grab bars can be painted in high contrast colors so that they can be seen easily by elderly patients with poor vision.

Other variants are possible without departing from the scope of the invention.

What is claimed is:

1. A dependent patient transfer device for transferring a patient from one support to another support, said device comprising:

(a) frame means having a wheeled base member and at least one upright member supported by said base member; wherein said base member includes a step portion for supporting said patient in a standing position and further includes foot rest means above said step portion; and (b) seat means carried by said frame means and being movable between (1) a first position for supporting said patient in a seated position; and (2) a second position which is out of the pathway of said patient during loading and unloading thereof.

2. A device in accordance with claim 1, further comprising seat support means pivotably attached to said upright member; wherein said seat support means is pivotable between said first and second positions.

3. A device in accordance with claim 2, wherein said seat means is detachably mounted to said seat support means.

4. A device in accordance with claim 2, wherein said seat means comprises a horizontally disposed shelf.

5. A device in accordance with claim 1, further comprising handle means for steering and pulling said device.

6. A device in accordance with claim 1, wherein there are two upright members supported by said base member; further comprising seat support means pivotably attached to said upright members; wherein said seat support means is pivotably between said first and second positions; and wherein said seat means is detachably mounted to said seat support means.

7. A device in accordance with claim 1, wherein said upright member further includes a grab bar for said patient to grip while in a standing position.

8. A dependent patient transfer device for transporting a patient from one support to another support, said device comprising:

(a) frame means having a wheeled base member and two spaced-apart upright members supported by said base member; wherein said base member further includes a step portion for supporting said patient in a standing position;

(b) seat means carried by said frame means and being movable between (1) a first position for supporting said patient in a seated position, and )2) a second position which is out of the pathway of said patient during loading and unloading thereof; and (c) seat support means pivotably attached to said upright members; wherein said seat support means is pivotable between said first and second positions; wherein said seat support means comprises first and second arms pivotably attached to said upright members; wherein said seat means comprises a horizontally disposed shelf which is detachably mounted to said arms.

9. A device in accordance with claim 8, wherein said seat means is detachably mounted to said seat support means.

10. A device in accordance with claim 9, wherein said seat means comprises a horizontally disposed shelf.

11. A device in accordance with claim 8, further comprising handle means for steering and pulling said device.

12. A device in accordance with claim 8, further comprising a grab bar supported between said upright members for said patient to grip.

* * * * *